US010814351B2

(12) United States Patent
Keener et al.

(10) Patent No.: US 10,814,351 B2
(45) Date of Patent: Oct. 27, 2020

(54) HIGH-VISCOSITY SEALANT APPLICATION SYSTEM

(71) Applicant: The Boeing Company, Chicago, IL (US)

(72) Inventors: Steven Glenn Keener, Trabuco Canyon, CA (US); Trent Rob Logan, Foothill Ranch, CA (US)

(73) Assignee: The Boeing Company, Chicago, IL (US)

( * ) Notice: Subject to any disclaimer, the term of this patent is extended or adjusted under 35 U.S.C. 154(b) by 928 days.

(21) Appl. No.: 13/964,713

(22) Filed: Aug. 12, 2013

(65) Prior Publication Data

US 2015/0044369 A1 Feb. 12, 2015

(51) Int. Cl.

| | |
|---|---|
| ***B05C 5/02*** | (2006.01) |
| ***B05B 13/04*** | (2006.01) |
| ***B05B 7/10*** | (2006.01) |
| ***B05D 5/00*** | (2006.01) |

(52) U.S. Cl.

CPC ..... *B05D 5/00* (2013.01); *B05B 7/10* (2013.01); *B05C 5/02* (2013.01); *B05C 5/0216* (2013.01)

(58) Field of Classification Search

USPC ..... 118/323, 321, 500, 666, 667, 663, 665; 427/256, 427.1–427.3; 239/583, 584

See application file for complete search history.

(56) References Cited

U.S. PATENT DOCUMENTS

| | | | | |
|---|---|---|---|---|
| 4,964,362 | A * | 10/1990 | Dominguez | 118/315 |
| 4,969,602 | A | 11/1990 | Scholl | |
| 4,983,109 | A | 1/1991 | Miller et al. | |
| 5,026,450 | A | 6/1991 | Cucuzza et al. | |
| 5,065,943 | A | 11/1991 | Boger et al. | |
| 5,194,115 | A | 3/1993 | Ramspeck et al. | |
| 5,462,199 | A * | 10/1995 | Lenhardt | 222/54 |
| 5,687,092 | A * | 11/1997 | Bretmersky et al. | 702/100 |
| 6,001,181 | A * | 12/1999 | Bullen | 118/679 |
| 6,364,218 | B1 * | 4/2002 | Tudor et al. | 239/290 |
| 6,514,569 | B1 * | 2/2003 | Crouch | B05C 5/0208 222/134 |
| 6,691,931 | B2 | 2/2004 | Kitajima | |
| 6,691,932 | B1 | 2/2004 | Schultz et al. | |
| 6,908,642 | B2 | 6/2005 | Hubert | |

(Continued)

FOREIGN PATENT DOCUMENTS

| | | | |
|---|---|---|---|
| CN | 1531464 | A | 9/2004 |
| CN | 1620340 | A | 5/2005 |

(Continued)

OTHER PUBLICATIONS

Extended European Search Report, dated Apr. 20, 2015, regarding Application No. EP14172557.2, 5 pages.

(Continued)

*Primary Examiner* — Yewebdar T Tadesse

(74) *Attorney, Agent, or Firm* — Yee & Associates, P.C.

(57) ABSTRACT

A method and apparatus for applying a sealant material. A nozzle system may be positioned relative to a structure using a robotic device. The sealant material may be applied in a number of streams onto a structure using the nozzle system and the robotic device to form a sealant deposit having a desired shape in which the sealant material has a viscosity greater than a selected threshold.

9 Claims, 8 Drawing Sheets

(56) References Cited

U.S. PATENT DOCUMENTS

| | | | |
|---|---|---|---|
| 2001/0042506 | A1 | 11/2001 | Hogan et al. |
| 2004/0011284 | A1 | 1/2004 | Schucker |
| 2005/0081784 | A1 | 4/2005 | Sakayori et al. |

FOREIGN PATENT DOCUMENTS

| | | | | |
|---|---|---|---|---|
| EP | 0819473 | A1 | | 1/1998 |
| EP | 2837430 | A2 | | 4/2015 |
| JP | H07265783 | A | | 10/1995 |
| JP | 05049997 | A | * | 1/2004 |
| JP | 2004154733 | A | | 6/2004 |
| JP | 2015036145 | A | | 2/2015 |

OTHER PUBLICATIONS

Canadian Office Action, dated Jan. 20, 2017, regarding Application No. 2855116, 4 pages.

State Intellectual Property Office of PRC Notification of First Office Action and English Translation, dated May 16, 2017, regarding Application No. 201410381641.6, 15 pages.

The State Intellectual Property Office of the People's Republic of China Notification of the Second Office Action and English Translation, dated Mar. 29, 2018, regarding Application No. 201410381641.6, 22 pages.

Japanese Notification of Reasons for Rejection and English Translation, dated Mar. 20, 2018, regarding Application No. 2014-153490, 19 pages.

Federal Institute of Industrial Property Office Action (Inquiry) of the Substantive Examination and English Translation, dated Mar. 29, 2018, regarding Application No. 2014125497/05(041477), 18 pages.

The State Intellectual Property Office of the People's Republic of China Notification of the Third Office Action and English Translation, dated Aug. 29, 2018, regarding application No. 201410381641.6, 24 pages.

Canadian Office Action with an Examination Search Report, dated Nov. 20, 2018, regarding Application No. CA2855116, 4 pages.

Japanese Notice of Reasons for Rejection and English translation, dated Nov. 13, 2018, regarding Application No. 2014-153490, 8 pages.

Japanese Office Action with English translation, dated Jul. 7, 2020, regarding Application No. JP2019-166408, 19 pages.

* cited by examiner

HIGH-VISCOSITY SEALANT APPLICATION SYSTEM

BACKGROUND INFORMATION

1. Field

The present disclosure relates generally to fluid application and, in particular, to high-viscosity sealant application. Still more particularly, the present disclosure relates to an apparatus and method for applying high-viscosity sealant materials using an automated system.

2. Background

A sealant material may be a viscous fluid that is used to provide a protective barrier that may prevent fluids and particulates from passing through the barrier. Further, a sealant material may be used to seal joints and other types of interfaces and features. In some cases, a sealant material may be used to protect a component against corrosion.

Sealant materials may be used in various industries including, but not limited to, the aerospace industry and the automotive industry, as well as other industries. In the aerospace industry, sealant materials may be used to seal assemblies, sub-assemblies, airframe components, wing components, and/or other types of components. Typically, the sealant materials used in the aerospace industry may be more viscous than the sealant materials used in the automotive industry. The sealant materials used in the aerospace industry may need to withstand a greater number of forces caused by operational loads and motions through air and/or space as compared to the sealant materials used in the automotive industry.

Different types of application systems may be used to apply sealant materials in the aerospace industry. As used herein, "applying" a sealant material may include dispensing the sealant material from a nozzle and/or adhering the sealant material to one or more surfaces. Dispensing the sealant material from the nozzle may also be referred to as ejecting the sealant material from the nozzle.

The high viscosity of the sealant materials used in the aerospace industry may make dispensing and applying these sealant materials more difficult than desired. Consequently, these sealant materials may need to be applied using manual methods. Traditional manual methods for applying a sealant material may include, for example, without limitation, brushing, dipping, rolling, and spraying the sealant material using a manual apparatus.

However, these methods for applying a sealant material may be more labor-intensive and time-consuming than desired. Further, these methods may be less exacting or controlled than desired. In some cases, a sealant material may need to be diluted with solvents to reduce the viscosity of the sealant material. For example, a sealant material may need to be diluted with solvents that are not environmentally-friendly to reduce the viscosity of the sealant material sufficiently for spraying operations. Additionally, the clean-up involved with these types of methods may be more extensive and/or expensive than desired.

Further, with these traditional methods for applying a sealant material, the amount, shape, and/or thickness of the sealant material applied may be less accurate than desired. As a result, meeting configuration requirements for the seal beads applied using these highly viscous sealant materials may be more difficult than desired. In some cases, a process of masking, unmasking, re-shaping, and/or trimming may be needed to improve seal bead configurations that are applied.

However, this process may be more labor-intensive and time-consuming than desired and may result in extensive rework.

Some currently available automated methods for dispensing and applying sealant materials used in the automotive industry may be suitable for use with those sealant materials of low-viscosity to medium-viscosity. For example, these methods may be suitable for sealant materials having a viscosity less than about 100,000 centipoise (cP). However, because of the high-viscosity, greater than about 100,000 centipoise, associated with and characteristic of the sealant materials used in the aerospace industry and the resulting challenges posed by these types of sealant materials, aerospace engineers may consider the automated application methods used in the automotive industry unsuitable for use with these types of sealant materials. Therefore, it would be desirable to have a method and apparatus that take into account at least some of the issues discussed above, as well as other possible issues.

SUMMARY

In one illustrative embodiment, an apparatus may comprise a robotic attachment element, a source attachment element, and a nozzle system. The robotic attachment element may be configured for attachment to a robotic device. The source attachment element may be configured for attachment to a source holding a sealant material having a viscosity greater than a selected threshold. The nozzle system may be configured to apply the sealant material onto a structure in a number of streams to form a sealant deposit having a desired shape.

In another illustrative embodiment, a sealant material application system may comprise a robotic attachment element, a source, a source attachment element, and a nozzle system. The robotic attachment element may be configured for use in attaching the sealant material application system to a robotic device. The source may hold a sealant material having a viscosity greater than about 100,000 centipoise. The source attachment element may be configured to attach the sealant material application system to the source. The nozzle system may be configured to apply the sealant material over a number of features of a structure in a number of streams with a desired level of consistency and accuracy to form a sealant deposit having a desired shape in which the sealant deposit is cured to form a seal over the number of features.

In yet another illustrative embodiment, a method for applying a sealant material may be provided. A nozzle system may be positioned relative to a structure using a robotic device. The sealant material may be applied in a number of streams onto a structure using the nozzle system and the robotic device to form a sealant deposit having a desired shape in which the sealant material has a viscosity greater than a selected threshold.

In still yet another illustrative embodiment, a method for applying a sealant material to a structure for an aerospace vehicle may be provided. A sealant material having a viscosity greater than a selected threshold may be received within a nozzle system in a sealant material application system. The nozzle system may be positioned relative to the structure using a robotic device such that the nozzle system is held at least 0.5 inches away from the structure during application of the sealant material onto the structure. The sealant material may be dispensed from the nozzle system. A viscosity of the sealant material may be changed during dispensing of the sealant material to change a flow rate of the sealant material being dispensed. The nozzle system may then be moved along the structure while the sealant material is being dispensed from the nozzle system using the robotic device to ensure that the sealant material is applied onto the structure in a number of streams according to a selected application pattern with a desired level of consistency and accuracy to form a sealant deposit having a desired shape. The sealant deposit may be cured to form a seal having a rigid surface and the desired shape within selected tolerances.

The features and functions described above can be achieved independently in various embodiments of the present disclosure or may be combined in yet a number of other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a method and apparatus for applying sealant materials having high viscosities. In particular, the illustrative embodiments recognize and take into account that it may be desirable to have a method and apparatus for applying sealant materials having viscosities greater than about 100,000 centipoise (cP).

Thus, the illustrative embodiments provide a method and apparatus for applying a sealant material. In one illustrative embodiment, a nozzle system may be positioned relative to a structure using a robotic device. The sealant material may be applied onto a structure in a desired pattern using the nozzle system and the robotic device in which the sealant material has a viscosity greater than a selected threshold. In this illustrative example, the sealant material may have a viscosity greater than about 100,000 centipoise.

Figure 1:
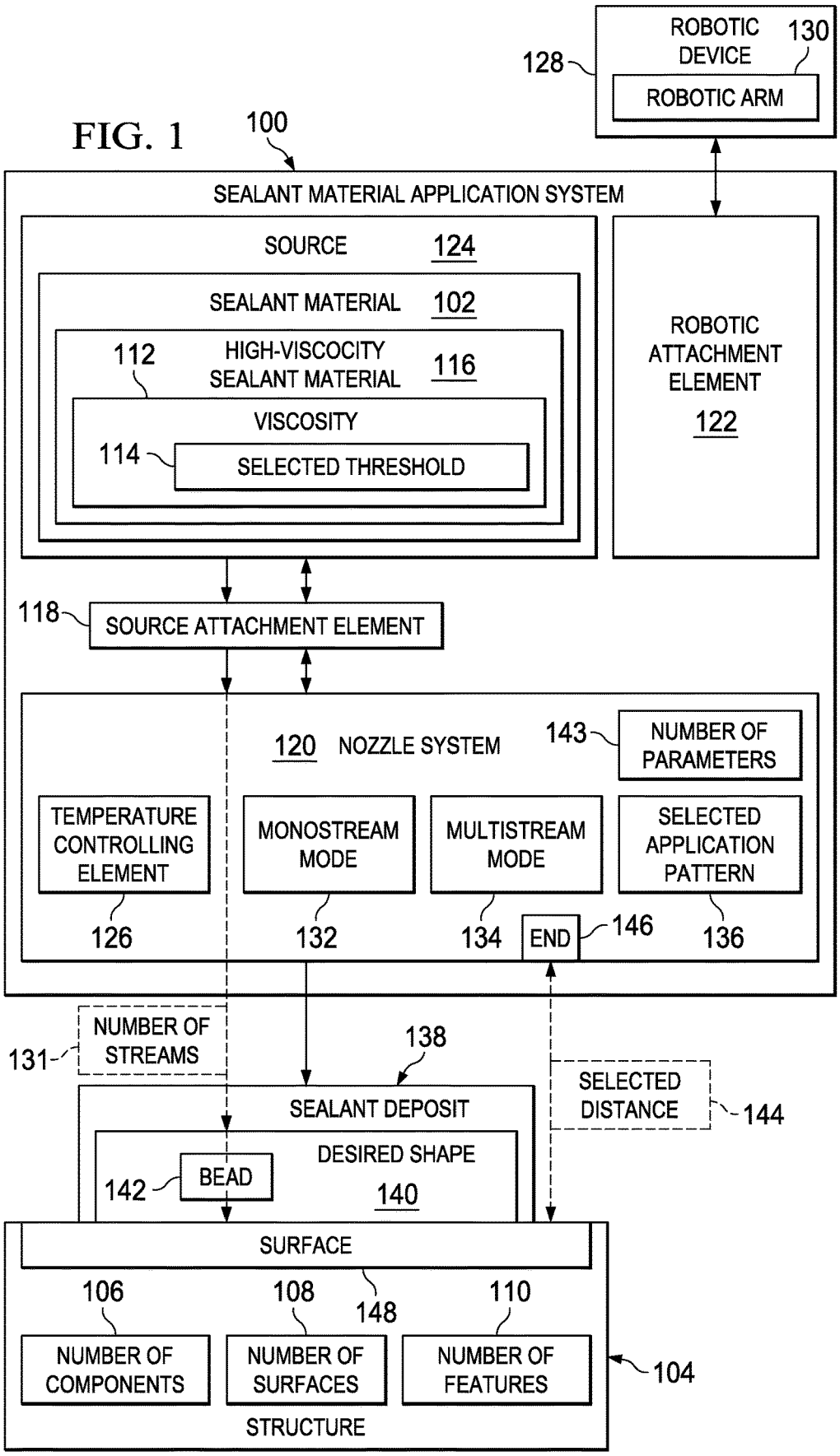
FIG. 1 is an illustration of a sealant material application system in the form of a block diagram in accordance with an illustrative embodiment.

Referring now to the figures and, in particular, with reference to FIG. 1, an illustration of a sealant material application system is depicted in accordance with an illustrative embodiment. In this illustrative example, sealant material application system 100 may be used to apply sealant material 102 onto structure 104. In particular, sealant material application system 100 may be used to both dispense, or eject, sealant material 102 and adhere sealant material 102 onto structure 104.

Structure 104 may take the form of a workpiece, an assembly of components, a sub-assembly, or some other type of structure. In one illustrative example, structure 104 may be comprised of number of components 106 and/or number of surfaces 108. As used herein, a "number of" items may be one or more items. In this manner, number of components 106 may include one or more components and number of surfaces 108 may include one or more surfaces.

Depending on the implementation, structure 104 may have number of features 110 exposed at one or more of number of surfaces 108 of structure 104 onto which sealant material 102 is to be applied. In other words, a feature in number of features 110 may require that sealant material 102 be applied to the feature. A feature in number of features 110 may take the form of, for example, without limitation, a joint, a fastener element, an end of a fastener element, an interface between one or more components, a groove, a seam, or some other type of feature.

In this illustrative example, sealant material 102 may have viscosity 112. Viscosity 112 may be a high viscosity greater than selected threshold 114. Selected threshold 114 may be, for example, without limitation, about 100,000 centipoise (cP). Of course, in other illustrative examples, selected threshold 114 may have a viscosity of about 200,000 centipoise, about 300,000 centipoise, or some other viscosity. In this manner, sealant material 102 may take the form of high-viscosity sealant material 116.

Depending on the implementation, sealant material 102 may be a single-component or multi-component formulation. In other words, sealant material 102 may be comprised of any number of materials.

As depicted, sealant material application system 100 may include source attachment element 118, nozzle system 120, and robotic attachment element 122. Source attachment element 118 may be configured for use in attaching source 124 to sealant material application system 100. In this illustrative example, source 124 may be a source of sealant material 102 with respect to sealant material application system 100. In other words, source 124 may be a device, a system, or other type of object used to deliver, or provide, sealant material 102 to sealant material application system 100. For example, without limitation, source 124 may take the form of a tank, a drum, a sealant cartridge, a sealant tube, a fluid container, or some other type of source. In one illustrative example, source 124 may take the form of a 55-gallon drum holding sealant material 102.

Nozzle system 120 may be configured for use in dispensing, or ejecting, sealant material 102. In this illustrative example, nozzle system 120 may be used for dispensing sealant material 102 at pressures above about 500 pounds per square inch (psi). In some illustrative examples, nozzle system 120 may be referred to as a sealant material dispensing nozzle system.

In one illustrative example, temperature controlling element 126 may be associated with nozzle system 120. As used herein, when one component is "associated" with another component, the association is a physical association in the depicted examples.

For example, without limitation, a first component, such as temperature controlling element 126, may be considered to be associated with a second component, such as nozzle system 120, by being secured or attached to the second component in some suitable manner. The first component also may be connected to the second component using a third component. Further, the first component may be considered to be associated with the second component by being part of and/or as an extension of the second component.

Temperature controlling element 126 may be configured to heat and/or cool sealant material 102 as sealant material 102 is dispensed through or from nozzle system 120. Sealant material 102 may be heated and/or cooled to change viscosity 112 of sealant material 102. For example, without limitation, heating sealant material 102 may cause viscosity 112 of sealant material 102 to be reduced. Cooling sealant material 102 may cause viscosity 112 of sealant material 102 to be increased.

In this manner, temperature controlling element 126 may be used to control viscosity 112 of sealant material 102 such that viscosity 112 is a desired viscosity, within selected tolerances. The desired viscosity may be selected such that sealant material 102 flows through and from nozzle system 120 in a desired manner, such as, for example, without limitation, at a desired rate. Thus, the manner in which sealant material 102 is applied onto structure 104 may be controlled using temperature controlling element 126.

Robotic attachment element 122 may be configured for use in attaching sealant material application system 100 to robotic device 128. Robotic device 128 may take a number of different forms. For example, without limitation, robotic device 128 may take the form of a robotic operator, a robotic arm, a robotic maneuvering system, a robotic manipulator, or some other type of autonomous or semi-autonomous system. In one illustrative example, robotic device 128 may take the form of robotic arm 130.

Sealant material application system 100 may be attached to robotic arm 130 through robotic attachment element 122. In this illustrative example, sealant material application system 100 may be considered an end effector for robotic arm 130. An end effector may also be referred to as an end-of-arm tooling (EOAT). In this manner, robotic attachment element 122 may be referred to as a robotic end-of-arm tooling attachment element.

In this illustrative example, robotic arm 130 may be used to guide, or maneuver, nozzle system 120. As used herein, "maneuvering" nozzle system 120 may include moving nozzle system 120, positioning nozzle system 120, and/or changing an orientation of nozzle system 120. Robotic arm 130 may be used to ensure that sealant material 102 is applied accurately and consistently. Further, using robotic arm 130 to maneuver or guide sealant material application system 100 may ensure that the application of sealant material 102 onto structure 104 may be repeated consistently, reliably, and accurately.

In this illustrative example, nozzle system 120 may be used to apply sealant material 102 onto structure 104 in a number of different ways. For example, without limitation, sealant material 102 may be dispensed from nozzle system 120 in number of streams 131 with nozzle system 120 in one of monostream mode 132 and multistream mode 134. In monostream mode 132, number of streams 131 may be a single stream of sealant material 102. In multistream mode 134, number of streams 131 may include two or more streams of material. In some illustrative examples, a stream of sealant material may be referred to as a strand, a filament, or a ribbon of sealant material.

As one illustrative example, sealant material 102 may be dispensed as one or more filaments from nozzle system 120 with nozzle system 120 in multistream mode 134. In particular, sealant material 102 may be applied as one or more thin filaments using a mechanically-assisted or airstream-directed application method. This mechanically-assisted or airstream-directed application method may be used to control or impart rotation and/or direction to sealant material 102 during the application of sealant material 102.

Of course, depending on the implementation, other modes may be used to apply sealant material 102 onto structure 104. These other modes may include, for example, without limitation, a contact mode, a non-contact mode, a pressure mode, a mixing mode, and/or other types of modes.

Further, nozzle system 120 may dispense sealant material 102 using selected application pattern 136. Selected application pattern 136 may be the pattern by which nozzle system 120 is moved in order to apply sealant material 102 onto structure 104. For example, without limitation, selected application pattern 136 may just be a linear pattern in which nozzle system 120 is translated in a particular direction as sealant material 102 is dispensed from nozzle system 120.

In another illustrative example, selected application pattern 136 may take the form of a swirl pattern in which nozzle system 120 is moved in circles, while being translated, to create swirls of sealant material 102 on structure 104. For example, without limitation, one or more strands of sealant material 102 may be swirled in controlled circles as sealant material 102 is applied onto structure 104.

In other words, the swirl pattern may be formed by applying sealant material 102 in the form of numerous, closely overlapping circles of thin sealant material 102. In some cases, pressurized air may be directed towards sealant material 102 as sealant material 102 is being dispensed from nozzle system 120 to stretch, or otherwise control and manipulate, the one or more strands of sealant material 102 being applied.

Nozzle system 120 may apply sealant material 102 onto structure 104 to form sealant deposit 138 having desired shape 140. Sealant deposit 138 may be sealant material 102 on structure 104 that has not yet been cured. Desired shape 140 may take the form of, for example, without limitation, bead 142. Bead 142 may be formed with nozzle system 120 in monostream mode 132 or multistream mode 134. Bead 142 may be a thick strand or ribbon of sealant material 102. In one illustrative example, sealant material application system 100 may be used to form bead 142 having a substantially uniform thickness and width over a length of bead 142.

Sealant material application system 100 may be configured to apply sealant material 102 in a stable and controlled pattern that may be consistently repeated as needed. Further, sealant material application system 100 may produce a pattern of sealant material 102 that is both adjustable and consistent with respect to dimensional and material characteristics. In this manner, sealant material application system 100 may be configured to apply sealant material 102 in a manner that may meet requirements such as, for example, without limitation, aerospace requirements.

For example, without limitation, number of parameters 143 for nozzle system 120 may be selected such that sealant deposit 138 is formed as desired. Number of parameters 143 may include at least one of a flow rate of sealant material 102, a temperature of sealant material 102, a translational speed of nozzle system 102, a rotational speed of nozzle system 102, or some other type of parameter.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required.

For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The flow rate of sealant material 102 may be the rate at which sealant material 102 flows through and out of nozzle system 120. Flow rate may also be referred to as exit velocity in some cases. The flow rate of sealant material 102 may be controlled by, for example, without limitation, controlling viscosity 112 of sealant material 102. Viscosity 112 of sealant material 102 may be changed to increase or decrease the flow rate of sealant material 102 being dispensed by changing the temperature of sealant material 102 using temperature controlling element 126 in nozzle system 120.

The translational speed of nozzle system 120 may be the speed at which nozzle system 120 moves in a particular direction along structure 104. Translational speed may also be referred to as travel speed in some cases. The rotational speed of nozzle system 120 may be the speed at which nozzle system 120 is rotated or the speed at which nozzle system 120 is moved in circles.

The translational speed and/or the rotational speed of nozzle system 120 may be changed to change the thickness and/or volume of sealant deposit 138 formed on structure 104. For example, without limitation, reducing the translational speed may increase the thickness and/or volume of sealant deposit 138 formed. Further, increasing the rotational speed may increase the thickness and/or volume of sealant deposit 138 formed.

Further, with sealant material application system 100, nozzle system 120 may be positioned at selected distance 144 from structure 104 during the application of sealant material 102. Selected distance 144 may be the distance between end 146 of nozzle system 120 and structure 104.

In one illustrative example, selected distance 144 may be a distance of about 0.5 inches or greater. For example, without limitation, robotic device 128 may be used to position nozzle system 120 at least about 0.5 inches away from structure 104 during the application of sealant material 102. In another example, robotic device 128 may be used to position nozzle system 120 at least about 1.0 inch away from structure 104 during the application of sealant material 102. Thus, sealant material application system 100 may be used to precisely dispense and apply sealant material 102.

The illustration of sealant material application system 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, without limitation, in some cases, source attachment element 118 may be associated with robotic attachment element 122. Depending on the implementation, source attachment element 118 may be attached to or part of robotic attachment element 122.

Although sealant material application system 100 is described above as being configured for use in the application of sealant material 102, sealant material application system 100 or an application system implemented in a manner similar to sealant material application system 100 may be used to apply other types of high-viscosity fluids onto structures. These high-viscosity fluids may include, for example, without limitation, adhesive materials, caulking materials, and/or other types of fluids. When used to apply a high-viscosity fluid other than sealant material 102, sealant material application system 100 may be referred to, generally, as a fluid application system.

Figure 2:
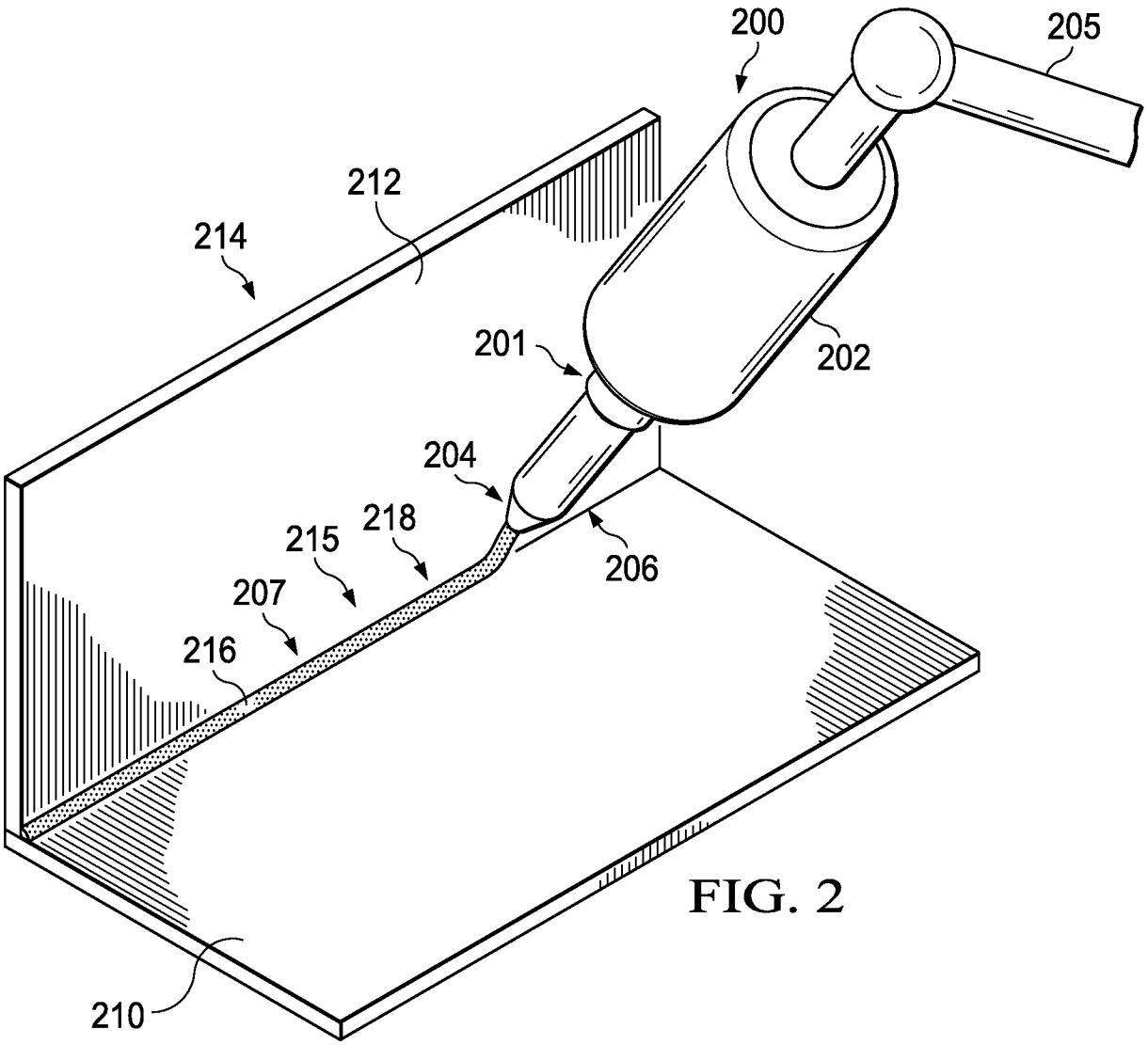
FIG. 2 is an illustration of a sealant material application system in accordance with an illustrative embodiment.

With reference now to FIG. 2, an illustration of a sealant material application system is depicted in accordance with an illustrative embodiment. In this illustrative example, sealant material application system 200 may be an example of one implementation for sealant material application system 100 in FIG. 1.

As depicted, sealant material application system 200 may include source attachment element 201, cartridge 202, nozzle system 204, and robotic attachment element 205. Source attachment element 201, cartridge 202, nozzle system 204, and robotic attachment element 205 may be examples of implementations for source attachment element 118, source 124, nozzle system 120, and robotic attachment element 122, respectively, from FIG. 1.

In this illustrative example, cartridge 202 may hold sealant material 207 having a viscosity of about 200,000 centipoise. Although cartridge 202 is shown as providing sealant material 207 in FIG. 2, other types of sources or delivery systems may be used to deliver, or provide, sealant material 207 to nozzle system 204 of sealant material application system 200.

Source attachment element 201 may be used to attach cartridge 202 to nozzle system 204. Nozzle system 204 may be used to dispense sealant material 207. Further, robotic attachment element 205 may be used to attach sealant material application system 200 to, for example, without limitation, a robotic device (not shown). The robotic device (not shown) may take the form of, for example, without limitation, a robotic arm such as robotic arm 130 in FIG. 1. Sealant material application system 200 may be operated by this robotic arm to ensure that sealant material 207 is applied with a desired level of reliability, consistency, and accuracy. In some illustrative examples, robotic attachment element 205 may also be used to attach sealant material application system 200 to other systems and/or devices.

In this illustrative example, sealant material application system 200 may be used to apply sealant material 207 to interface 206 formed between component 210 and component 212 of structure 214. In particular, sealant deposit 215 is formed over interface 206. Sealant deposit 215 may be an example of one implementation for sealant deposit 138 in FIG. 1. As depicted, sealant material application system 200 may be maneuvered or positioned relative to structure 214 such that nozzle system 204 may be held at least one inch away from interface 206.

Further, in this illustrative example, sealant material application system 200 may be used to form bead 216. Bead 216 may be an example of one implementation for bead 138 in FIG. 1. Bead 216 may have a substantially uniform thickness and width along the length of bead 216. Bead 216 may form seal 218 at interface 206 when bead 216 is cured, or hardened. In this illustrative example, seal 218 may maintain the shape of bead 216. However, in other examples, bead 216 may be reworked, or reshaped, such that seal 218 may be formed having some other shape or configuration. For example, without limitation, bead 216 may be reshaped such that seal 218 is formed having a shape that meets specified requirements. Cross-sectional views of different types and configurations of seals are depicted in FIG. 3 below.

The illustration of sealant material application system 200 in FIG. 2 is not meant to imply physical or architectural limitations to the manner in which an illustrative embodiment may be implemented. Other components in addition to or in place of the ones illustrated may be used. Some components may be optional.

The different components shown in FIG. 2 may be illustrative examples of how components shown in block form in FIG. 1 can be implemented as physical structures. Additionally, some of the components in FIG. 2 may be combined with components in FIG. 1, used with components in FIG. 1, or a combination of the two.

Figure 3:
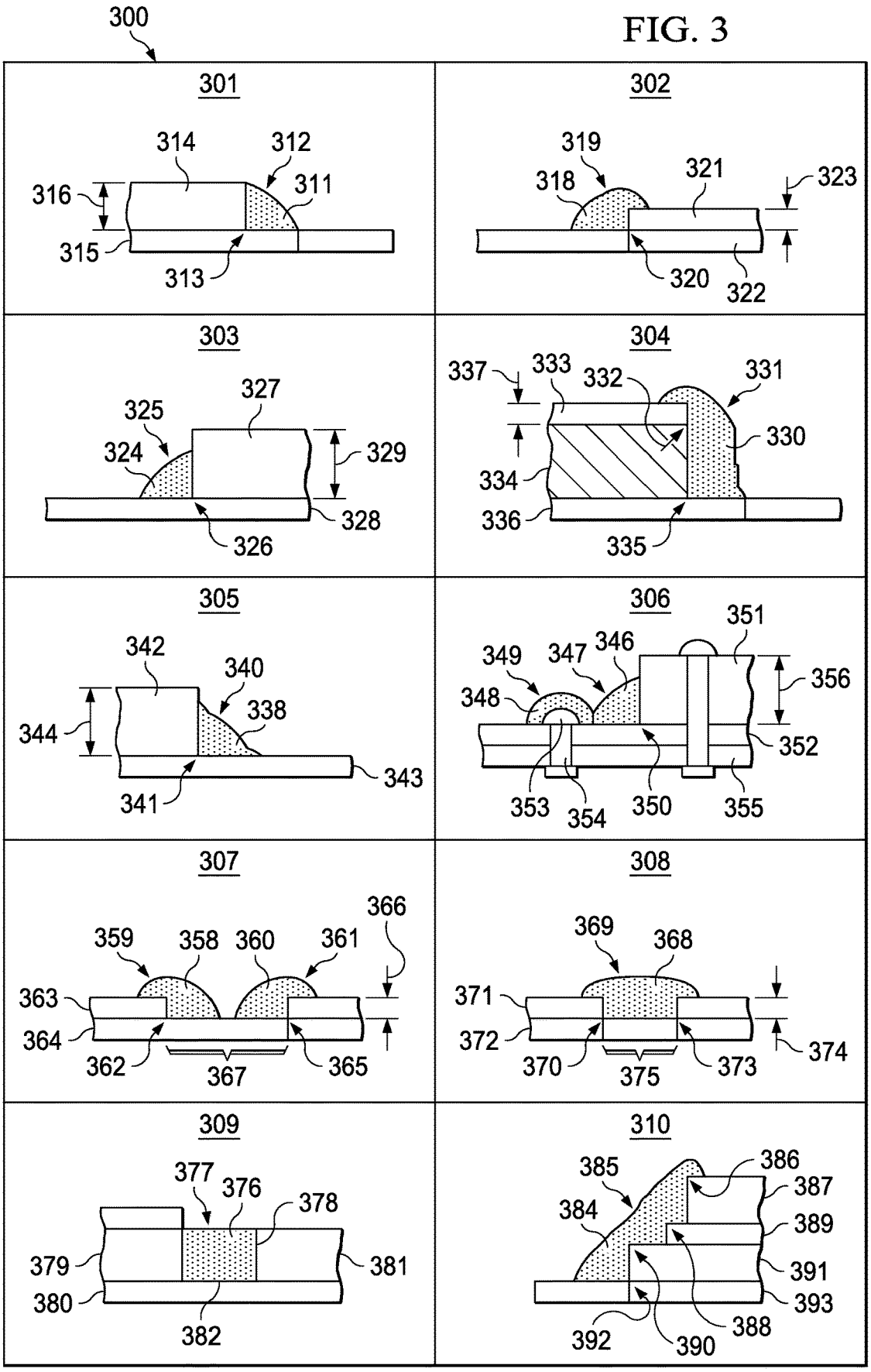
FIG. 3 is an illustration of a table of scenarios in which different shapes of seal beads may be formed in accordance with an illustrative embodiment.

With reference now to FIG. 3, an illustration of a table of cross-sectional views of scenarios in which different shapes of seal beads may be formed is depicted in accordance with an illustrative embodiment. In this illustrative example, table 300 may include scenarios 301, 302, 303, 304, 305, 306, 307, 308, 309, and 310. Each of these scenarios may identify the shape of a seal bead needed to seal, cover, and/or protect a feature, such as, for example, without limitation, an edge or a corner, based on the properties associated with the feature. Each of the seal beads described below may be an example of one implementation for bead 138 in FIG. 1.

In scenario 301, sealant material has been used to form seal bead 311 having shape 312. Seal bead 311 may be formed at corner 313 formed by first component 314 and second component 315. Shape 312 of seal bead 311 may be a bead shape in this illustrative example. Shape 312 may be selected for seal bead 311 based on thickness 316 of first component 314.

Further, in scenario 302, sealant material has been used to form seal bead 318 having shape 319. Seal bead 318 may be formed at corner 320 formed by first component 321 and second component 322. Shape 319 may be selected for seal bead 318 based on thickness 323 of first component 321.

In scenario 303, sealant material has been used to form seal bead 324 having shape 325. Seal bead 324 may be formed at corner 326 formed by first component 327 and second component 328. Shape 325 may be selected for seal bead 324 based on thickness 329 of first component 327.

As depicted in scenario 304, sealant material has been used to form seal bead 330 having shape 331. Seal bead 330 may be formed at edge 332 formed by first component 333 and second component 334 and corner 335 formed by second component 334 and third component 336. Shape 331 may be selected for seal bead 330 based on thickness 337 of first component 333.

Further, in scenario 305, sealant material has been used to form seal bead 338 having shape 340. Seal bead 338 may be formed at corner 341 formed by first component 342 and second component 343. Shape 340 selected for seal bead 338 may be formed based on thickness 344 of first component 342.

In scenario 306, sealant material has been used to form seal bead 346 having shape 347 and seal bead 348 having shape 349. Seal bead 346 may be formed at corner 350 formed by first component 351 and second component 352. Seal bead 348 may be formed over end 353 of fastener element 354 joining second component 352 and third component 355. Shape 347 may be selected for seal bead 346 based on thickness 356 of first component 351, while shape 349 may be selected for seal bead 348 based on the shape and/or size of end 353 of fastener element 354.

Scenario 307 may be different in that sealant material has been used to form seal bead 358 having shape 359 and seal bead 360 having shape 361. Seal bead 358 may be formed at corner 362 formed by first component 363 and second component 364, while seal bead 360 may be formed at corner 365 formed by first component 363 and second component 364. Shape 359 and shape 361 may be selected for seal bead 358 and seal bead 360, respectively, based on thickness 366 of first component 363 and distance 367 between corner 362 and corner 365. In scenario 307, seal bead 358 and seal bead 360 may be formed such that these seals do not contact each other.

As depicted, sealant material has been used to form seal bead 368 having shape 369 in scenario 308. Seal bead 368 may be formed at corner 370 and corner 373 formed by first component 371 and second component 372. Shape 369 may be selected for seal bead 368 based on thickness 374 of first component 371 and distance 375 between corner 370 and corner 373.

Further, sealant material has been used to form seal bead 376 having shape 377 in scenario 309. Seal bead 376 may be formed in groove 378 formed between first component 379, second component 380, and third component 381. Shape 377 for seal bead 376 may be selected based on shape 382 of groove 378.

Still further, in scenario 310, sealant material has been used to form seal bead 384 having shape 385. Seal bead 384 may be formed to seal bead and cover edge 386 of first component 387, edge 388 of second component 389, edge 390 of third component 391, and corner 392 formed by third component 391 and fourth component 393.

The shapes, or configurations, of seal beads depicted in table 300 may only be examples of shapes that may be formed using sealant material. These shapes may be formed, in particular, using a sealant material application system such as sealant material application system 100 in FIG. 1 and/or sealant material application system 200 in FIG. 2.

Figure 4:
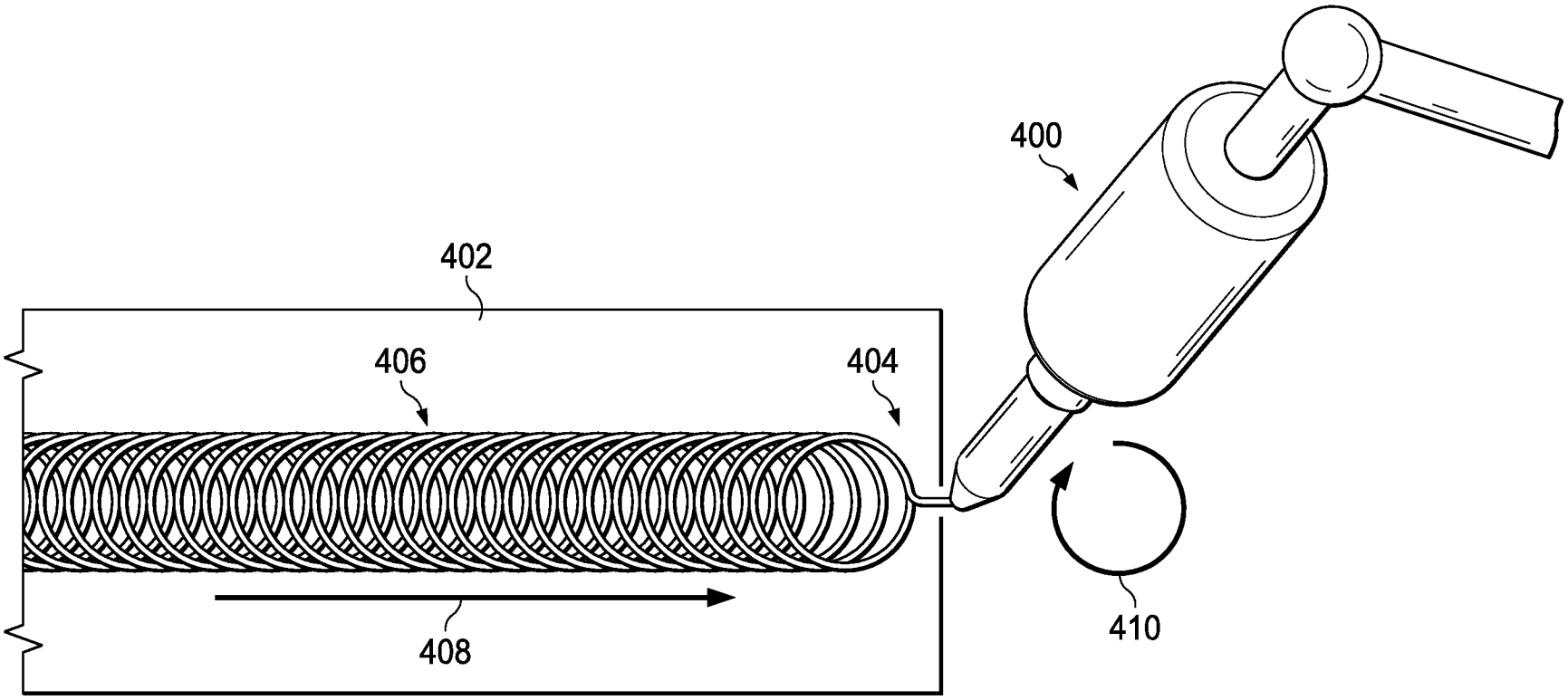
FIG. 4 is an illustration of a nozzle system forming a sealant deposit using a swirl pattern in accordance with an illustrative embodiment.

With reference now to FIG. 4, an illustration of a nozzle system forming a sealant deposit using swirl pattern 406 is depicted in accordance with an illustrative embodiment. In this illustrative example, nozzle system 400 may be an example of one implementation for nozzle system 120 in FIG. 1.

As depicted, nozzle system 400 is used to apply sealant material onto surface 402 to form sealant deposit 404. Sealant deposit 404 may be an example of one implementation for sealant deposit 138 in FIG. 1. In this illustrative example, nozzle system 400 may be operated in a monostream mode, such as monostream mode 132 in FIG. 1. Further, nozzle system 400 may use swirl pattern 406 to form sealant deposit 404.

As depicted, nozzle system 400 may be translated in the direction of arrow 408, while being moved in circles in clockwise direction 410 to form sealant deposit 404. The translational speed of nozzle system 400 moving in the direction of arrow 408 and the rotational speed of nozzle system 400 moving in clockwise direction 410 may determine the thickness, volume, and/or shape of sealant deposit 404 formed on surface 402.

Figure 5:
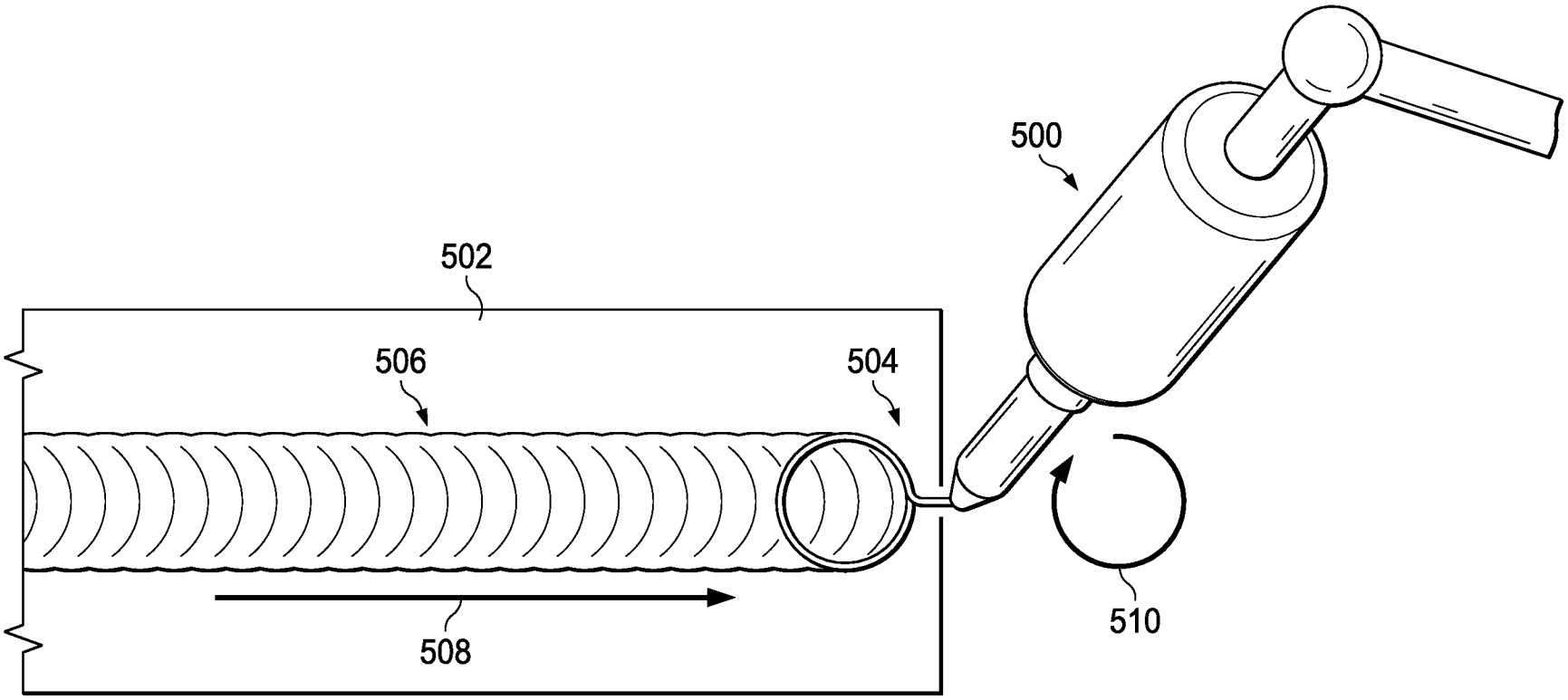
FIG. 5 is an illustration of a nozzle system forming a sealant deposit using a swirl pattern in accordance with an illustrative embodiment.

With reference now to FIG. 5, an illustration of a nozzle system forming a sealant deposit using swirl pattern 506 is depicted in accordance with an illustrative embodiment. In this illustrative example, nozzle system 500 may be an example of one implementation for nozzle system 120 in FIG. 1.

As depicted, nozzle system 500 is used to apply sealant material onto surface 502 to form sealant deposit 504. Sealant deposit 504 may be an example of one implementation for sealant deposit 138 in FIG. 1. In this illustrative example, nozzle system 500 may be operated in a monostream mode, such as monostream mode 132 in FIG. 1. Further, nozzle system 500 may use swirl pattern 506 to form sealant deposit 504.

As depicted, nozzle system 500 may be translated in the direction of arrow 508, while being moved in circles in clockwise direction 510 to form sealant deposit 504. The translational speed of nozzle system 500 moving in the direction of arrow 508 and the rotational speed of nozzle system 500 moving in clockwise direction 510 may determine the thickness, volume, and/or shape of sealant deposit 504 formed on surface 502.

In this illustrative example, sealant deposit 504 may have a greater thickness, contain a higher volume of sealant material, and form a more solid shape as compared to sealant deposit 404 in FIG. 4. In particular, nozzle system 500 is moved at a slower translational speed and faster rotational speed than nozzle system 400 in FIG. 4.

Figure 6:
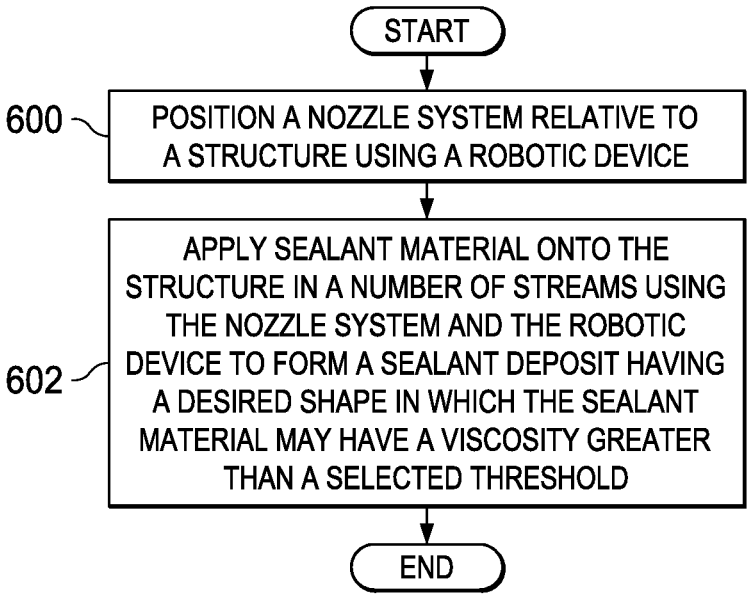
FIG. 6 is an illustration of a process for applying sealant material in the form of a flowchart in accordance with an illustrative embodiment.

With reference now to FIG. 6, an illustration of a process for applying sealant material is depicted in the form of a flowchart in accordance with an illustrative embodiment. The process illustrated in FIG. 6 may be implemented using sealant material application system 100 in FIG. 1.

The process may begin by positioning nozzle system 120 relative to structure 104 using robotic device 128 (operation 600). In this illustrative example, maneuvering nozzle system 120 relative to structure 104 may include positioning nozzle system 120 such that nozzle system 120 is held at a desired distance from structure 104.

Thereafter, sealant material 102 may be applied onto structure 104 in number of streams 131 using nozzle system 120 and robotic device 128 to form sealant deposit 138 having desired shape 140 in which sealant material 102 may have viscosity 112 greater than selected threshold 114 (operation 602), with the process terminating thereafter. In operation 602, selected threshold 114 may be about 100,000 centipoise.

Further, in operation 602, nozzle system 120 may be configured to receive sealant material 102 from source 124 and dispense sealant material 102 such that sealant material 102 may be applied onto structure 104. Sealant material 102 may be applied onto structure 104 by maneuvering nozzle system 120 relative to structure 104 as sealant material 102 is dispensed from nozzle system 120. Maneuvering nozzle system 120 relative to structure 104 may include, for example, without limitation, moving nozzle system 120, positioning nozzle system 120, guiding nozzle system 120, and/or changing an orientation of nozzle system 120 relative to structure 104.

Desired shape 140 for sealant deposit 138 may be, for example, without limitation, bead 142. Nozzle system 120 may move according to selected application pattern 136 to form sealant deposit 138 having desired shape 140. Further, nozzle system 120 may be operated in, for example, without limitation, monostream mode 132, multistream mode 134, or some other type of mode, depending on the implementation, using robotic device 128, to form sealant deposit 138. Using robotic device 128 to maneuver nozzle system 120 may ensure that operation 602 may be performed in an accurate and controlled manner.

Figure 7:
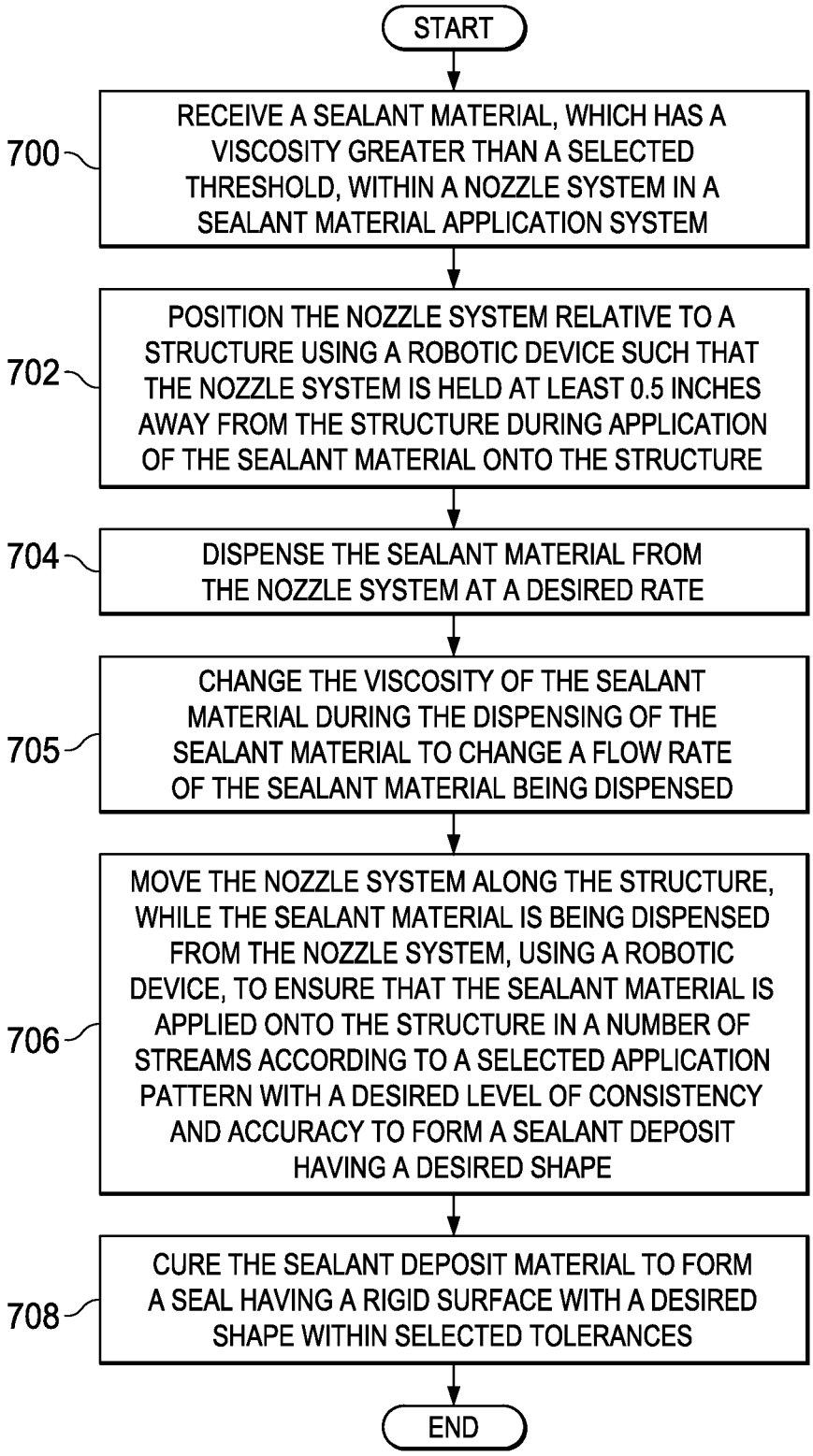
FIG. 7 is an illustration of a process for applying a sealant material onto a structure of an aerospace vehicle in the form of a flowchart in accordance with an illustrative embodiment.

With reference now to FIG. 7, an illustration of a process for applying a sealant material onto a structure of an aerospace vehicle is depicted in the form of a flowchart in accordance with an illustrative embodiment. The process illustrated in FIG. 7 may be implemented using sealant material application system 100 in FIG. 1 to apply sealant material 102 onto structure 104 in FIG. 1.

The process may begin by receiving sealant material 102, which has viscosity 112 greater than selected threshold 114, within nozzle system 120 in sealant material application system 100 (operation 700). In operation 700, selected threshold 114 may be about 100,000 centipoise. Nozzle system 120 may then be positioned relative to structure 104 using robotic device 128 such that nozzle system 120 is held at least 0.5 inches away from structure 104 during application of sealant material 102 onto structure 104 (operation 702).

Thereafter, sealant material 102 may be dispensed from nozzle system 120 at a desired rate (operation 704). Viscosity 112 of sealant material 102 may be changed during the dispensing of sealant material 102 to change a flow rate of sealant material 102 being dispensed (operation 705).

Nozzle system 120 may be moved along structure 104, while sealant material 102 is being dispensed from nozzle system 120, using robotic device 128, to ensure that sealant material 102 is applied onto structure 104 in number of streams 131 according to selected application pattern 136 with a desired level of consistency and accuracy to form sealant deposit 138 having desired shape 140 (operation 706).

Next, sealant deposit 138 may be cured to form a seal having a rigid surface with desired shape 140 within selected tolerances (operation 708), with the process terminating thereafter. Operation 708 may be performed by activators present in sealant material 102. These activators may have been mixed into or combined with sealant material 102 during the flow of sealant material 102 through nozzle system 120 and/or at the outputting of sealant material 102 from nozzle system 120.

Of course, in some cases, operation 708 may be performed using a curing system that uses ultraviolet light, heat, pressure, and/or other types of methods to cure sealant material 102. In some cases, curing may be formed at normal ambient temperatures. In this manner, operation 708 may be performed using any number of curing methodologies currently available, depending on the type of sealant material 102 used.

In this manner, sealant material application system 100 may be used to apply sealant material 102 consistently and precisely for different types of structures. These structures may be structures within an aerospace vehicle.

Figure 8:
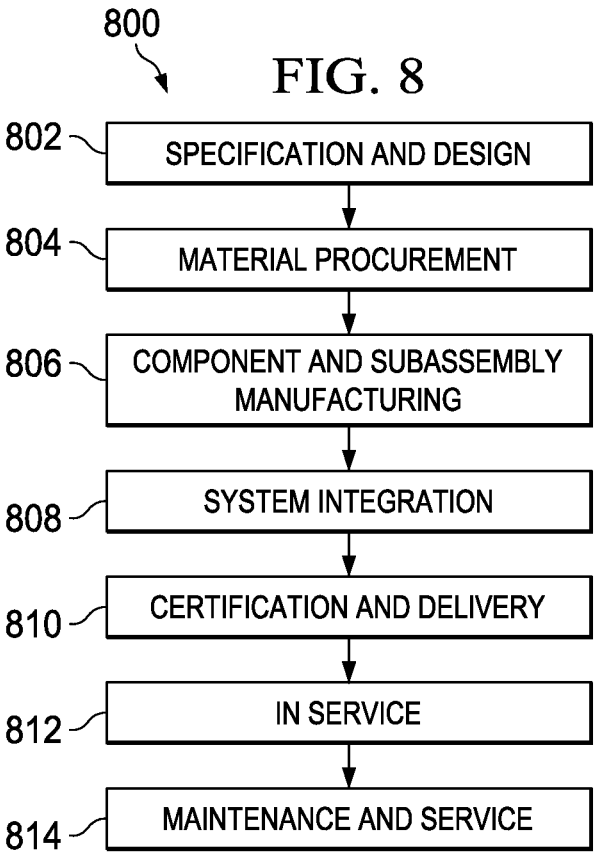
FIG. 8 is an illustration of an aircraft manufacturing and service method in the form of a flowchart in accordance with an illustrative embodiment.
Figure 9:
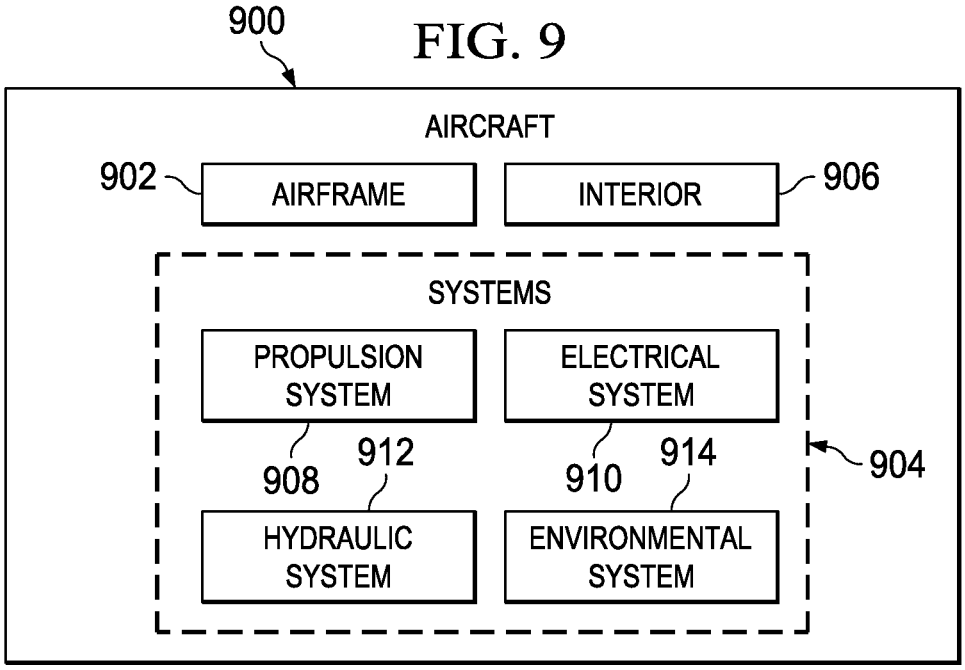
FIG. 9 is an illustration of an aircraft in the form of a block diagram in accordance with an illustrative embodiment.

Illustrative embodiments of the disclosure may be described in the context of aircraft manufacturing and service method 800 as shown in FIG. 8 and aircraft 900 as shown in FIG. 9. Turning first to FIG. 8, an illustration of an aircraft manufacturing and service method is depicted in the form of a flowchart in accordance with an illustrative embodiment. During pre-production, aircraft manufacturing and service method 800 may include specification and design 802 of aircraft 900 in FIG. 9 and material procurement 804.

During production, component and sub-assembly manufacturing 806 and system integration 808 of aircraft 900 in FIG. 9 takes place. Thereafter, aircraft 900 in FIG. 9 may go through certification and delivery 810 in order to be placed in service 812. While in service 812 by a customer, aircraft 900 in FIG. 9 is scheduled for routine maintenance and service 814, which may include modification, reconfiguration, refurbishment, and other maintenance or service.

Each of the processes of aircraft manufacturing and service method 800 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 9, an illustration of an aircraft is depicted in which an illustrative embodiment may be implemented. In this example, aircraft 900 is produced by aircraft manufacturing and service method 800 in FIG. 8 and may include airframe 902 with plurality of systems 904 and interior 906. Examples of systems 904 include one or more of propulsion system 908, electrical system 910, hydraulic system 912, and environmental system 914. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 800 in FIG. 8. In particular, sealant material application system 100 from FIG. 1 may be used to apply sealant material 102 onto one or more structures of airframe 902 of aircraft 900 during any one of the stages of aircraft manufacturing and service method 800. For example, without limitation, sealant material application system 100 from FIG. 1 may be used to apply sealant material 102 during at least one of component and sub-assembly manufacturing 806, system integration 808, in service 812, routine maintenance and service 814, or some other stage of aircraft manufacturing and service method 800.

In one illustrative example, components or sub-assemblies produced in component and sub-assembly manufacturing 806 in FIG. 8 may be fabricated or manufactured in a manner similar to components or sub-assemblies produced while aircraft 900 is in service 812 in FIG. 8. As yet another example, one or more apparatus embodiments, method embodiments, or a combination thereof may be utilized during production stages, such as component and sub-assembly manufacturing 806 and system integration 808 in FIG. 8. One or more apparatus embodiments, method embodiments, or a combination thereof may be utilized while aircraft 900 is in service 812 and/or during maintenance and service 814 in FIG. 8. The use of a number of the different illustrative embodiments may substantially expedite the assembly of and/or reduce the cost of aircraft 900.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a structure, wherein the structure is selected from one of a workpiece, an assembly of components, and a sub-assembly;

a robotic attachment element configured for attachment to a robotic device, wherein the robotic device is configured to move the nozzle system relative to the structure such that the sealant material is applied with a desired level of consistency and accuracy;

a source attachment element configured for attachment to a source holding a sealant material having a viscosity greater than a selected threshold of about 100,000 centipoise; and a nozzle system positioned at least 1.0 inches away from the structure during application of the sealant material onto the structure and configured to apply the sealant material onto the structure in a number of streams to form a sealant deposit having a desired shape wherein the desired shape of the sealant deposit is a bead having a substantially uniform thickness and width along a length of the bead, wherein the nozzle system is configured to apply the sealant material onto the structure in one of a monostream mode and a multistream mode using a selected application pattern, wherein the selected application pattern is a swirl pattern;

the nozzle system having a temperature controlling element configured to alter a temperature of the sealant material flowing through the nozzle system to change the viscosity of the sealant material to control an exit velocity of the sealant material.

2. The apparatus of claim 1, wherein the nozzle system is configured to apply the sealant material in the number of streams over a number of features of the structure such that the sealant deposit cures to form a seal over the number of features having the desired shape.

3. The apparatus of claim 2, wherein a feature in the number of features is selected from one of a joint, a fastener element, an end of a fastener element, an interface between one or more components, a groove, and a seam.

4. The apparatus of claim 3, wherein the structure comprises a number of components for an aerospace vehicle.

5. The apparatus of claim 4, wherein the robotic attachment element, the source attachment element, and the nozzle system form a sealant material application system.

6. The apparatus of claim 5, wherein the sealant material that is applied onto the structure is cured to form a seal having a rigid surface and the desired shape within selected tolerances.

7. The apparatus of claim 6, wherein the sealant material application system is an end effector for the robotic device.

8. The apparatus of claim 6, wherein the source is a sealant cartridge.

9. A sealant material application system comprising:

a structure for an aerospace vehicle, wherein the structure is selected from one of a workpiece, an assembly of components, and a sub-assembly;

a robotic attachment element configured for use in attaching the sealant material application system to a robotic device;

a source holding a multi-component sealant material having a viscosity greater than about 100,000 centipoise;

a source attachment element configured to attach the sealant material application system to the source;

a nozzle system positioned at least 1.0 inches away from the structure and configured to eject the sealant material at a pressure greater than 500 pounds per square inch in a swirl pattern over a number of features of the structure in a number of streams with a desired level of consistency and accuracy to form a sealant deposit having a substantially uniform thickness and width along the length of the bead in which the sealant deposit is cured to form a seal having a rigid surface over the number of features, wherein the thickness of the sealant deposit is controlled by controlling a translational speed of the nozzle system; and a temperature controlling element associated with the nozzle system and configured to control a temperature of the sealant material flowing through the nozzle system to change the viscosity of the sealant material within selected tolerances in order to achieve a desired exit velocity.

* * * * *